US008998403B2

(12) United States Patent
Fletcher et al.

(10) Patent No.: US 8,998,403 B2
(45) Date of Patent: Apr. 7, 2015

(54) MEDIA TACKING TO MEDIA TRANSPORT USING A MEDIA TACKING BELT

(71) Applicant: Xerox Corporation, Norwalk, CT (US)

(72) Inventors: Gerald M. Fletcher, Pittsford, NY (US); Joannes N. M. de Jong, Hopewell Junction, NY (US); Peter J. Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 67 days.

(21) Appl. No.: 13/669,578

(22) Filed: Nov. 6, 2012

(65) Prior Publication Data

US 2014/0125748 A1 May 8, 2014

(51) Int. Cl.
*B41J 2/01* (2006.01)
*B41J 11/00* (2006.01)

(52) U.S. Cl.
CPC ..... *B41J 11/007* (2013.01)

(58) Field of Classification Search
USPC ..... 347/104, 101, 8, 16
See application file for complete search history.

(56) References Cited

U.S. PATENT DOCUMENTS

| | | | | |
|---|---|---|---|---|
| 5,132,712 | A * | 7/1992 | Fletcher et al. | 347/55 |
| 6,508,540 | B1 * | 1/2003 | Lean et al. | 347/55 |
| 8,157,369 | B2 | 4/2012 | Hoover et al. | |
| 8,408,539 | B2 * | 4/2013 | Moore | 271/193 |
| 2010/0021219 | A1 * | 1/2010 | Hori | 399/388 |
| 2010/0118099 | A1 * | 5/2010 | Ito | 347/104 |
| 2010/0194795 | A1 * | 8/2010 | Tsuchiya et al. | 347/1 |
| 2011/0062657 | A1 | 3/2011 | Williams et al. | |
| 2013/0278693 | A1 * | 10/2013 | Bellisario | 347/104 |

OTHER PUBLICATIONS

U.S. Appl. No. 13/589,356, filed Aug. 17, 2012, Fletcher et al. "System and Method for Adjusting an Electrostatic Field in an Inkjet Printer."

U.S. Appl. No. 13/557,784, filed Jul. 25, 2012, Fletcher et al., "A System and Method for Reducing Electrostatic Fields Underneath Print Heads in an Electrostatic Media Transport."

* cited by examiner

*Primary Examiner* — Henok Legesse
(74) *Attorney, Agent, or Firm* — Fay Sharpe LLP

(57) ABSTRACT

When tacking print media to a print media transport belt in a printer, a tack module having a pair of nips is employed to control charge migration in across the print media in order to tolerate lead edge curl while ensuring uniform printing. An upstream nip is formed by a first bias transfer roll and a first backup roll, and a downstream nip is formed by a second bias transfer roll and a second backup roll. The respective backup rolls are offset slightly upstream of the respective bias transfer rolls. Charge of opposite polarities is applied to the first backup roll and the second bias transfer roll to facilitate taking of the print media to the print media transport belt.

24 Claims, 4 Drawing Sheets

MEDIA TACKING TO MEDIA TRANSPORT USING A MEDIA TACKING BELT

TECHNICAL FIELD

The presently disclosed embodiments are directed toward controlling charge migration across print media during printing. It will be appreciated, however, that the described embodiments may find application in other charge migration control systems, other printing techniques, and/or other print media control techniques.

BACKGROUND

In order to ensure good print quality in direct to paper (DTP) ink jet printing systems, it is desirable to hold the print media extremely flat in the print zone. Conventional approaches use electrostatic tacking of media to a moving transport belt that is held flat against a platen in the imaging zones. Conventional electrostatic tacking methods create a tacking field by primarily applying charges to the media side that is not in contact with the tacking surface (transport belt). The charges can be applied by well-known methods in the art including the use of various non-contact corona charging devices or the use of various pressured devices such as a biased roller. Generally, pressured devices such as biased roller charging can be preferred because the presence of mechanical pressure helps to tack stressful media such as curled or cockled media. In any case of conventional tacking, charge decay from the top of the media toward the tacking surface during the dwell times between imaging stations adversely affects the fields between the media and the imaging heads at certain stress media conductivity conditions where the charge decay rate is comparable to the dwell times. Moreover, in conventional tacking using a pressured device such as (bias transfer roll) BTR roll tacking, air breakdown charge exchange can occur between the media and the transport belt at the BTR exit when the media has lead edge curl away from the belt transport, and this greatly reduces tacking force on the lead edge of such curled print media, thereby causing undesirable low tacking force between the lead edge of the media and the belt transport.

For ease of discussion, we will discuss conventional charging using a BTR, but the general points made apply to all other forms of conventional charging (for example charging by other pressured bias charging devices or charging via non-contact corona devices). Conventional BTR charging applies initial charge primarily to the surface of the media that is facing the BTR rather than to the surface that is facing the transport belt, causing the charge to conductively migrate or "relax" toward the interface between the media and the belt transport during the dwell times between print zones. The time for this charge relaxation can vary by more than 6 orders of magnitude for media conditioned over extremes of relative humidity. This charge relaxation creates fields between the media and subsequent print heads past the $1^{st}$ print head when the charge relaxation rate is comparable to the dwell time between printing head stations.

Another solution to avoiding fields between the media and print heads and the effect of media conductivity on these fields mentioned above involves the use of slots in the metal support below each imaging head. With appropriate optimized media charge conditioning past the BTR zone and slots that are sufficiently wide, that the fields between the media and the imaging heads can be kept very low below all of the imaging heads independent of media conductivity. However, very wide slots are not desirable for optimized maintenance of belt flatness in the imaging zones, and so some compromise in the slot width is typically needed. At a compromised narrower slot width, dependence on the media conductivity of the fields between the media and the heads can occur and this can cause similar issues mentioned for the non-slotted metal support.

Another disadvantage of conventional BTR charging methods occurs in media that has lead edge curl toward the BTR. Charge transfer from the BTR to the media is typically dominated by air breakdown, which includes charge transfer just past the BTR nip. With media curl toward the BTR, air breakdown past the nip can occur above and below the media, and this lowers the net charge on the lead edge and thereby greatly lowers the electrostatic tack force between the lead edge and the transport. This in turn greatly increases the danger of up-curl media damaging the downstream print heads. A conventional countermeasure to mitigate this phenomenon is to provide a pre-curl device prior to the BTR zone to ensure that the media lead edge is curled toward the transport. However, high curl toward the transport is not desirable and it is difficult to ensure that the media lead edge will always be curled down for all media and all environmental conditions if the pre-curl stage is confined to minimize the amount of curl.

There is a need in the art for systems and methods that facilitate providing a tacking system that allowed high tack force on the lead edge so that some level of up curl could be allowed while overcoming the aforementioned deficiencies.

BRIEF DESCRIPTION

In one aspect, a system that facilitates controlling charge migration across print media during printing comprises first and second backup rolls, first and second bias transfer rolls, an upstream nip formed by the first backup roll and the first bias transfer roll, which are offset relative to each other in the process direction, and a downstream nip formed by the second backup roll and the second bias transfer roll, which are offset relative to each other in the process direction. The system further comprises a tack belt that surrounds the first backup roll and the second bias transfer roll and passes through the upstream nip and the downstream nip, and a media transport belt that passes through the downstream nip.

In another aspect, a tack module that facilitates tacking print media to a media transport belt in a printer comprises first and second backup rolls, first and second bias transfer rolls. The first backup roll and the first bias transfer roll form an upstream nip and are offset relative to each other in the process direction. The second backup roll and the second bias transfer roll form a downstream nip and are offset relative to each other in the process direction. The tack module further comprises a tack belt that surrounds the first backup roll and the second bias transfer roll and passes through the upstream nip and the downstream nip.

In yet another aspect, a method for tacking print media to a media transport belt in a printer comprises applying a pressure blade to the print media to cause the print media to contact a first backup roll prior to entering an upstream nip formed by the first backup roll and a first bias transfer roll, applying a first charge having a first polarity to a surface of the print media in contact with the first bias transfer roll, and applying a second charge having a second polarity to a tack belt surface that faces away from the print media. The method further comprises applying a third charge having the second polarity and a magnitude equal to that of the first charge to a second bias transfer roll, forcing a breakdown charge exchange to occur between a second backup roll and a print media transport belt surface that faces away from the print media, and maintaining a charge of the first polarity on the print media and a charge of the second polarity on a print media transport belt surface that faces away from the print media as the print media passes an imagine head.

DETAILED DESCRIPTION

Figure 1:
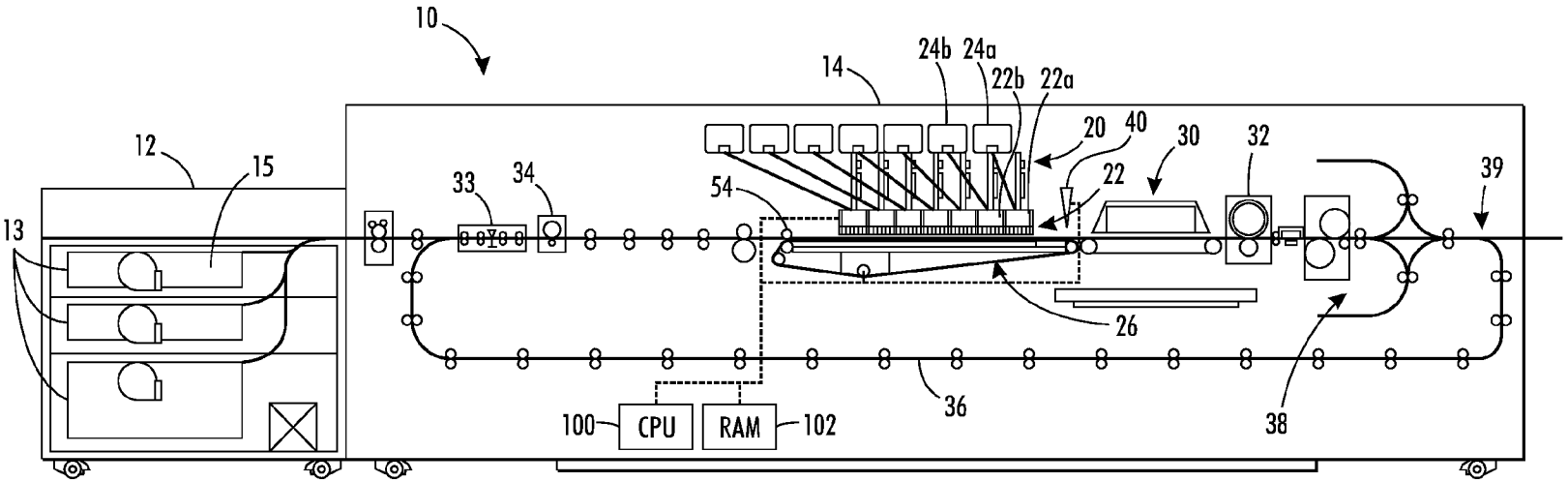
FIG. 1 shows an example of a production printing system in which the described innovation can be employed, in accordance with various features described herein.

The above-described problem is solved by applying electrostatic charges to the side of the media that faces the belt transport while still maintaining high tack force. Instead of a conventional BTR for charging the media, the described systems and methods employ a tacking belt wrapped around at least two rolls. Although a BTR is described herein as a charging device for illustrative purposes, any suitable contact or non-contact charging device or means may be employed in conjunction with the herein-described systems and methods, as will be appreciated by those of skill in the art. For example, various other contacting charging devices or various types of non-contacting corona charging devices (with or without a pressure blade to more properly lead the paper into the corona device) can be employed.

One side of the media is tacked to the tacking belt at the upstream roll using BTR-type electrostatic tacking methods. Then, the tacking belt transport delivers the media to a media transport belt. At the delivery point, a roll at downstream end of the tacking belt transport is a BTR that is loaded against the media transport belt. A nip is formed between the downstream BTR and an opposing nip that is located beneath the media transport belt. Thus the downstream BTR nip captures the media and media transport belt. A voltage across this nip tacks the media to the media transport belt. Media that have lead edge curl toward the transport belt are very low stress for maintaining eventual good lead edge control during the subsequent imaging steps when the media is escorted past the imaging heads on the transport belt. Media that are curled away from the transport belt are very high stress and these require net high charge density on the lead edge to achieve good lead edge control during imaging. With conventional charging media curled away from the transport belt will have low net charge on the lead edge due to large air gaps between the media and the transport belt. It is known in the art that such large air gaps will limit the net charge due to air breakdown limitations. With the tacking belt configuration being described, media with curl away from the transport belt is curled toward the tacking belt and this creates small air gaps between the media and the tacking belt so that high net charge density can be applied to the lead edge of such stressful curled media. Moreover, the charge is initially substantially applied to the side of the media that will eventually face the transport belt. The charge density and thus the tacking forces on the lead edge of stressful media which have curl away from the media transport belt, are much larger than is achieved with conventional tacking methods and by depositing initial charge on the transport side of the media the use of the tacking belt overcomes the disadvantages associated with the influence of media conductivity on the fields between the media and the print heads. In this manner, charge migration across the print media is controlled during printing and transport problems associated with stressful lead edge curl is mitigated. In this manner, the described systems and methods facilitate ensuring that media charge is substantially at the media-to-belt transport interface independent of the media resistivity (e.g., due to moisture or the like), while still maintaining ultra-high tacking force to the media transport belt.

FIG. 1 shows an example of a production printing system 10 in which the described innovation can be employed, in accordance with various features described herein. Media is transported onto the hold-down print zone transport 12 using a traditional nip based registration transport with nip releases. As soon as the lead edge of the media is acquired by the hold-down transport in the media acquisition area 14, the registration nips are released. Media acquisition by the print zone transport can be performed via a vacuum belt transport. One or more inks 16 or the like are applied to the print media, and the printed media is transported to an ultraviolet cure zone 18.

Figure 2:
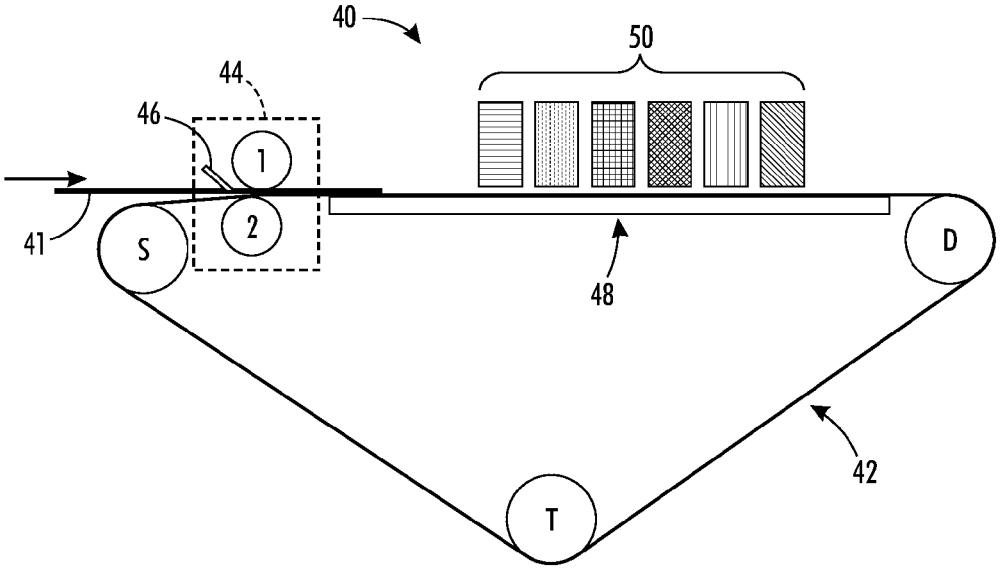
FIG. 2 shows a print zone transport that uses electrostatic forces to tack paper/media onto the hold-down transport belt, in accordance with various features described herein.

FIG. 2 shows a print zone transport 40 that uses electrostatic forces to tack paper/media 41 onto the hold-down transport belt 42, in accordance with various features described herein. In this case, the belt can be fabricated out of relatively insulating (e.g., volume resistivity typically greater than $10^{12}$ ohm-cm) material. Alternatively, the belt can include layers of semi-conductive material if the topmost layer is relatively insulating material. If semi-conductive layers are employed, a quantity "volume resistivity in the lateral or cross direction divided by the thickness of the layer" can be selected to be above $10^8$ ohms/square for any such included layers. FIG. 2 thus shows an exemplary media tacking approach that is improved by the subject innovation. The belt transport consists of a drive roll (D), tensioning roll (T) and steering Roll (S). Two rolls (labeled 1 and 2) are used. Roll 1 is positioned on top of the belt 42 and/or media 41, and roll 2 is positioned below the belt. A high voltage is supplied across roll 1 and 2 to produce tacking charges in an electrostatic tacking zone 44. Either roll 1 or roll 2 may be grounded. An optional blade 46 may be used to enhance tacking by forcing the paper/media against the transport just prior to the roller nip. With a grounded metal support 48 in the print zones 50 will, the charges on the media and transport belt can cause high fields between the media and the grounded print heads, which can adversely affect imaging under certain conditions.

Figure 3:
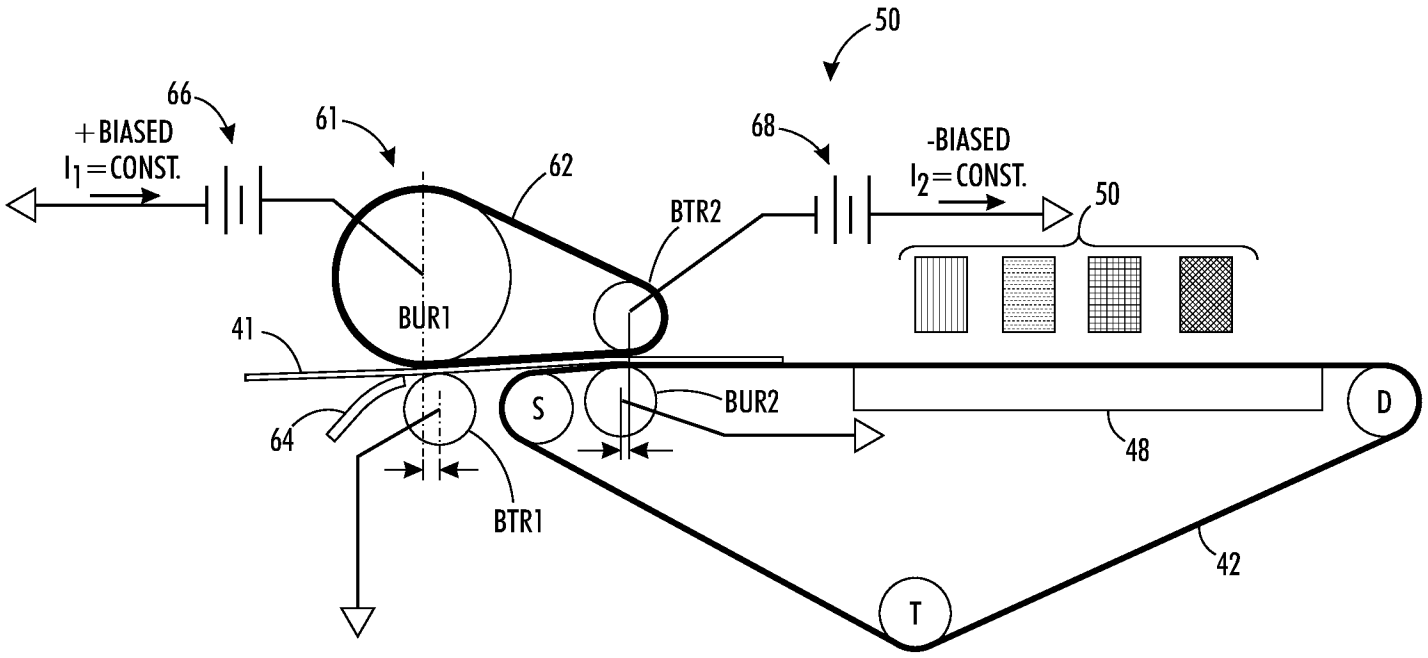
FIG. 3 illustrates a printing system having a tack belt module comprising at least two rolls BUR1 and BTR1 with a tacking belt wrapped around them, in accordance with various features described herein.

FIG. 3 illustrates a printing system 60 having a tack belt module 61 comprising at least two rolls, including a back-up roll (BUR1) and a first charging device, such as a bias transfer roll (BTR1), with a tacking belt 62 wrapped around them, in accordance with various features described herein. The tacking belt 62 can be an insulator, semiconductor, or some other suitable material. A sheet of print media 41 is fed into an upstream nip between rolls BUR1 and BTR1. The upstream nip together with a pressure blade 64 facilitates tacking media to the tack belt. It will be noted that electrostatic charges are predominately applied to the bottom of the media at this point. The media is transported to a downstream nip between at least two additional rolls BUR2 and a second charging device, such as a second bias transfer roll BTR2, for tacking to the media transport belt 42. Here, the bias is opposite of bias at the upstream nip. In one embodiment, power supplies 66, 68 are controlled to provide constant current. The power supply polarity and current flow $I_1$ direction for the BUR1 may be positive or negative, and the polarity of the current flow $I_2$ direction for the BUR2 is opposite to that of current flow $I_1$. For ease of discussion the polarities and bias arrangements shown in FIG. 3 are described, although one of skill in the art will appreciate, it is possible to configure the system with, for example, BUR1 grounded and BTR1 biased, BUR2 biased and BTR2 grounded, etc.

The illustrated tack belt configuration ensures that the charge on the media predominately ends up on the side of the media facing the media transport belt in the imaging head zones 50 (e.g., ink jet ejection zones or areas), independent of the media conductivity, while maintaining high charge density. It will be noted that the initial charge deposited onto the media in the BTR1 zone is mainly on the bottom side of the media. As mentioned in initial discussion of BTR charging, this is a consequence of BTR charging due to the dominance of air breakdown charge exchange. This holds true even for stress curl up media because the curl up causes an air gap on the tack belt side of the media to be small at the lead edge so that air breakdown charge exchange between the media and tack belt is minimal (e.g., any post nip air breakdown occurs mainly between the BTRs and the media).

With the polarity shown in FIG. 3, negative charge is predominantly deposited onto the BTR1 side of the media and positive charge is deposited onto the back of the tack belt. This allows deposition of high charge density onto the lead edge of curl up media, which will be part of the eventual source of the high tack force between the lead edge of the curled up media and the media transport belt at the exit of the BUR2/BTR2 nip. The media is tacked to the tack belt due to the negative charge on the media and the positive charge on the tack belt substrate. Note that this charge is now on the side of the media that will eventually face the media transport.

In the BTR2/BUR2 zone, the polarities and geometry are chosen to predominately create air breakdown charge exchange between the BUR2 and the media transport belt and to minimize any air breakdown charge exchange between the media and the tack belt. With the polarities shown in FIG. 3, positive polarity charge is deposited onto the substrate of the media transport belt. Since the BUR2 is shifted sufficiently upstream (e.g., 3 mm or so) of BTR2 so that the media transport leaves the surface of BUR2 prior to the media leaving the surface of the BTR2, then air breakdown charge exchange will begin between the BUR2 and the media transport belt before any air breakdown charge exchange might begin between the media and tack belt. This in turn places positive polarity charge on the bottom of the media transport belt, thereby providing the added source of high tack force between the negatively charged media and the media transport belt. If the current $I_1$ is chosen to be comparable (and opposite polarity) to $I_2$, then minimal charge exchange occurs between the media and the tack belt past the BTR2/BUR2 nip. Thus, the media charge exiting the BTR2/BUR2 nip is high and predominately on the side of the media facing the media transport belt for the stress high resistivity media case.

Lower resistivity media conditions exhibit lower stress for ensuring that the charge on the media in the imaging head zones is on the side of the media that faces the media transport belt. For example, in a case where the relaxation time for charge flow across the media thickness is comparable to or much, much faster than the dwell time between the time between the BTR1/BUR1 zone and the BTR2/BUR2 zone, then charge initially deposited on the transport side of the media in the BTR1/BUR1 zone will migrate (conduct) to the tack belt side of the media during the dwell time between the BTR1/BUR1 and the BTR2/BUR2 zones. As an example, consider the stressful case where the charge flow across the media is much faster than the well time. In this case the initial charge on the media when it emerges from the BTR2/BUR2 zone can be initially substantially away from the media surface facing the transport belt. However, if the distance between the BTR2/BUR2 zone and the first imaging station is made longer than the distance between the BUR1/BTR1 and BUR2/BTR2 zone any charge on the top of media surface initially after the BUR2/BTR2 zone will decay toward the side of media facing the media transport belt during the dwell time between the BTR2/BUR2 zone and the first imaging zone. Thus the charge will be substantially on the side of the media facing the transport belt during the entire dwell time that the media transports past the imaging heads for low stress lower resistivity media conditions as well as for high stress high resistivity media conditions.

In this manner the system 60 provides a solution to the problem of dependency on the media conductivity of the field between the media and the imaging heads by predominantly placing the charge on the side of the media that is facing the transport rather than on the side that is away from the transport. The charge on the media is at the interface between the media and the transport during the dwell time for transport past the imaging heads, independent of the media conductivity. Thus, the electrostatic field at the first imaging station is the same as at the last imaging station independent of the media conductivity. The electrostatic field can be adjusted by various means to approach zero or any other constant level desired.

It might be thought that high charge density can be applied to the transport side of the media by simply for example passing the media in the air past a charging device without the presence of a tacking belt as previously described. However, it is well known in the art of charging that due to Paschen air breakdown, charge typically cannot be applied to the transport side of the media in the air prior to the BTR zone except at very low net charge density and hence low tack force. The described system 60 provides high net charge density that is substantially on the transport side of the media during the dwell time between imaging stations, in contrast to conventional approaches.

It will be noted in the described system 60 that the BTR1 roll is shifted downstream of top dead center, and the pre-nip pressure blade 64 is applied to cause paper tangency prior to the BTR1 nip to prevent air breakdown charge exchange between the paper and the BTR1/BUR1 nip, which negatively charges the paper on the BTR1 side and positively charges the back of the tack belt 62. The tack belt lead-in geometry and BUR2 position (which is shifted upstream of the BUR2 nip) is chosen to ensure contact between the paper, the paper transport belt, and the tack belt nip prior to the BTR2/BUR2 nip to prevent pre-nip air breakdown charge exchange between the paper and the paper transport belt, as well as between the paper and the tack belt. The BTR2 roll is biased to the opposite polarity of the BUR1 roll, and the magnitude of the BUR1 and BTR2 currents are chosen to be equal. This feature, when combined with the BTR2 position being shifted downstream, forces substantially all of the breakdown charge exchange at BTR2/BUR2 to occur between the BUR2 and the paper transport. With the polarities shown in FIG. 3, the bottom of the paper transport is positively charged and the bottom of the paper is negatively charged, and the magnitudes of the two charge densities are comparable since the same current is applied.

Figure 4:
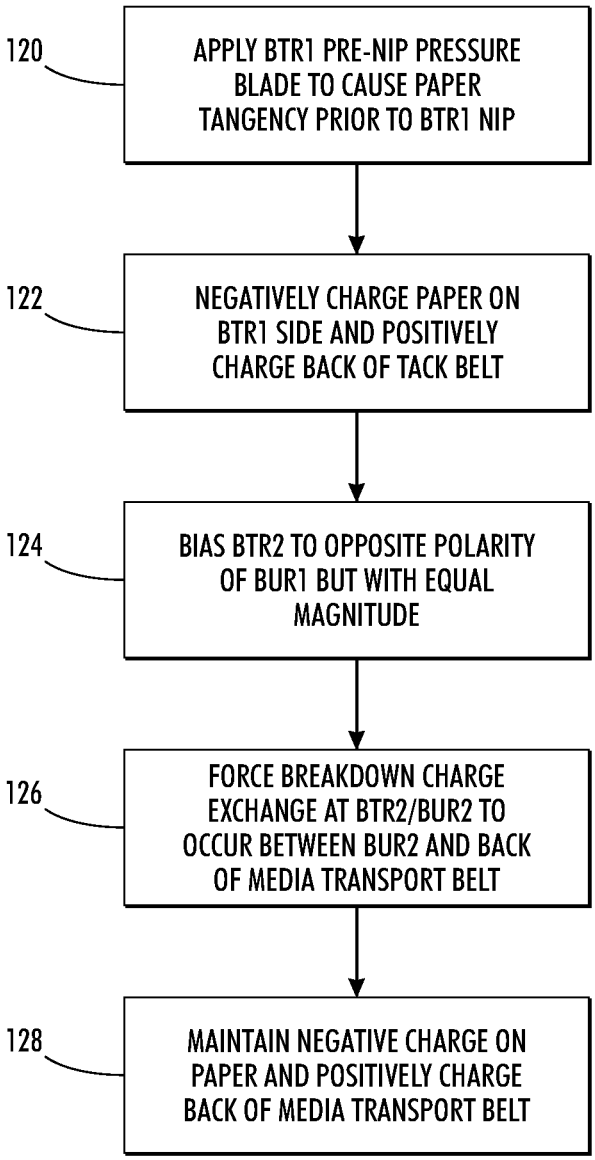
FIG. 4 illustrates a method for controlling charge mitigation during printing on a stress high resistivity media, in accordance with one or more features described herein.

FIG. 4 illustrates a method for controlling charge mitigation during printing on a stress high resistivity media, in accordance with one or more features described herein. The negative polarity chosen for the paper charge is chosen for ease of discussion, and it can be recognized that a positive polarity for the paper charge could alternatively be chosen. At 120, a BTR1 pre-nip pressure blade can be applied to cause paper tangency prior to the BTR1 nip interface. At 122, the print media is negatively charged on the BTR1 side, while the back of the tack belt is positively charged. At 124, the BTR roll is biased to a polarity opposite of the BUR1 at an applied current that is substantially of equal magnitude to the current used at the BTR1. At 126, breakdown charge exchange at the BTR2/BUR2 interface is forced to substantially occur between the BUR2 roll and the media transport belt. At 128, negative charges are maintained on the print media, and positive charge of substantially equal value is applied to the back of the media transport belt.

The described systems and methods provide superior tacking forces that can be provided using conventional approaches, in order to hold the media flat against the belt with media curl away from the media transport belt. Media properties (e.g. moisture) do not adversely affect the field in the imaging zone, and therefore the field can be readily adjusted using suitable controls to be near zero or to any constant value desired. Additionally, the described systems and methods do not require slots in the platen to ensure zero net field under the ink ejection area.

The exemplary embodiments have been described with reference to the preferred embodiments. Modifications and alterations may occur to others upon reading and understanding the preceding detailed description. It is intended that the exemplary embodiments be construed as including all such modifications and alterations insofar as they come within the scope of the appended claims or the equivalents thereof.

The invention claimed is:

1. A system for controlling charge migration across print media during printing, comprising:

first and second backup rolls;

first and second charging devices;

an upstream nip formed by the first backup roll and the first charging device, which are offset relative to each other in a process direction;

a downstream nip formed by the second backup roll and the second charging device, which are offset relative to each other in the process direction;

a tack belt that surrounds the first backup roll and the second charging device and passes through the upstream nip and the downstream nip; and a media transport belt that passes through the downstream nip.

2. The system according to claim 1, wherein the first and second charging devices are bias transfer rolls.

3. The system according to claim 2, further comprising a pressure blade positioned upstream from the upstream nip, wherein the pressure blade biases print media upward toward the first backup roll as the print media enters the upstream nip.

4. The system according to claim 2, wherein the first bias transfer roll applies a first charge to a bottom surface of the print media as it passes through the upstream nip, and wherein the second bias transfer roll applies a second charge to a top surface of the print media as it passes through the downstream nip.

5. The system according to claim 4, wherein the second charge is opposite in polarity, and equal in magnitude, to the first charge.

6. The system according to claim 2, wherein the center of the first bias transfer roll is downstream of the center of the first backup roll with which the first bias transfer roll forms the upstream nip.

7. The system according to claim 2, wherein the center of the first bias transfer roll is approximately 3 mm downstream of the center of the first backup roll with which the first bias transfer roll forms the upstream nip.

8. The system according to claim 2, wherein the center of the second bias transfer roll is downstream of the center of the second backup roll with which the second bias transfer roll forms the downstream nip.

9. The system according to claim 2, wherein the center of the second bias transfer roll is approximately 3 mm downstream of the center of the second backup roll with which the second bias transfer roll forms the downstream nip.

10. The system according to claim 2, further comprising a platen and at least one imaging head, between which the media transport passes downstream of the second nip.

11. The system according to claim 10, wherein the second backup roll is positioned downstream from the first backup roll by a first predetermined distance, and upstream from the at least one imaging head by a second predetermined distance, and wherein the second predetermined distance is larger than the first predetermined distance.

12. A tack module that facilitates tacking print media to a media transport belt in a printer, comprising:

first and second backup rolls;

first and second charging devices;

wherein the first backup roll and the first charging device form an upstream nip and are offset relative to each other in a process direction;

wherein the second backup roll and the second charging device form a downstream nip and are offset relative to each other in the process direction; and a tack belt that surrounds the first backup roll and the second charging device and passes through the upstream nip and the downstream nip.

13. The tack module according to claim 12, wherein the first and second charging devices are bias transfer rolls.

14. The tack module according to claim 13, further comprising a pressure blade positioned upstream from the upstream nip, wherein the pressure blade biases print media upward toward the first backup roll as the print media enters the upstream nip.

15. The tack module according to claim 13, wherein the first bias transfer roll applies a first charge to a bottom surface of the print media as it passes through the upstream nip, and wherein the second bias transfer roll applies a second charge to a top surface of the print media as it passes through the downstream nip.

16. The tack module according to claim 15, wherein the second charge is opposite in polarity, and equal in magnitude, to the first charge.

17. The tack module according to claim 13, wherein the center of the first bias transfer roll is downstream of the center of the first backup roll with which the first bias transfer roll forms the upstream nip.

18. The tack module according to claim 13, wherein the center of the first bias transfer roll is approximately 3 mm downstream of the center of the first backup roll with which the first bias transfer roll forms the upstream nip.

19. The tack module according to claim 13, wherein the center of the second bias transfer roll is downstream of the center of the second backup roll with which the second bias transfer roll forms the downstream nip.

20. The tack module according to claim 13, wherein the center of the second bias transfer roll is approximately 3 mm downstream of the center of the second backup roll with which the second bias transfer roll forms the downstream nip.

21. The tack module according to claim 13, wherein the second backup roll is positioned downstream from the first backup roll by a first predetermined distance, and upstream from at least one imaging head by a second predetermined distance, and wherein the second predetermined distance is larger than the first predetermined distance.

22. A method for tacking print media to a media transport belt in a printer, comprising:

applying a pressure blade to the print media to cause the print media to contact a first backup roll prior to entering an upstream nip formed by the first backup roll and a first charging device;

applying a first charge having a first polarity to a surface of the print media in contact with a first bias transfer roll;

applying a second charge having a second polarity to a tack belt surface that faces away from the print media;

applying a third charge having the second polarity and a magnitude equal to that of the first charge to a second charging device;

forcing a breakdown charge exchange to occur between a second backup roll and a print media transport belt surface that faces away from the print media; and maintaining a charge of the first polarity on the print media and a charge of the second polarity on the print media transport belt surface that faces away from the print media as the print media passes an image head.

23. The method according to claim 22, wherein a center of the first charging device is downstream of a center of the first backup roll with which the first charging device forms the upstream nip, and wherein center of the second charging device is downstream of a center of the second backup roll with which the second charging device forms a downstream nip.

24. The method according to claim 22, wherein the first and second charging devices are bias transfer rolls.

* * * * *